US006381913B2

(12) United States Patent
Herren

(10) Patent No.: US 6,381,913 B2
(45) **Date of Patent: *May 7, 2002**

(54) STUD FOR CONSTRUCTION OF SEISMIC AND FIRE RESISTANT SHAFT WALLS

(76) Inventor: Thomas Ross Herren, 1160 N. Blue Gum Ave., Anaheim, CA (US) 92806

( * ) Notice: Subject to any disclaimer, the term of this patent is extended or adjusted under 35 U.S.C. 154(b) by 0 days.

This patent is subject to a terminal disclaimer.

(21) Appl. No.: 09/900,563

(22) Filed: Jul. 6, 2001

Related U.S. Application Data

(63) Continuation of application No. 09/436,527, filed on Nov. 9, 1999.

(51) Int. Cl.[7] ..... E04C 2/34

(52) U.S. Cl. ..... 52/481.1; 52/481.2; 52/479; 52/489.1; 52/729.5; 52/731.5

(58) Field of Search ..... 52/731.5

(56) References Cited

U.S. PATENT DOCUMENTS

| | | | | |
|---|---|---|---|---|
| 3,094,197 A | * | 6/1963 | Attwood | 189/34 |
| 3,940,899 A | | 3/1976 | Balinski | |
| 4,152,878 A | | 5/1979 | Balinski | |
| 4,364,212 A | | 12/1982 | Pearsop | |
| 4,720,957 A | | 1/1988 | Madray | |
| 4,866,899 A | | 9/1989 | Houser | |
| 5,127,203 A | | 7/1992 | Paquette | |
| 5,440,854 A | * | 8/1995 | Hohmann | 52/489.1 |
| 5,724,784 A | | 3/1998 | Menchetti | |
| 5,729,945 A | * | 3/1998 | Menchetti et al. | 52/481.1 |
| 5,913,788 A | * | 6/1999 | Herren | 52/241 |
| 5,950,285 A | | 9/1999 | Herren | |
| 5,950,385 A | * | 9/1999 | Herren | 52/481.1 |
| 6,047,508 A | | 4/2000 | Goodman | |
| 6,216,404 B1 | * | 4/2001 | Vellrath | 52/232 |

* cited by examiner

*Primary Examiner*—Carl D. Friedman
*Assistant Examiner*—Basil Katcheves

(57) ABSTRACT

A stud for construction of fire resistant and seismic resistant shaft walls (10), including but not limited to elevator shafts and stairwells. The claimed metal stud is used for constructing shaft wall assemblies which can withstand vertical, and horizontal movements due to seismic forces, wind sway, and inter-story drift resulting from gravity and the rotation of the earth. This stud comprises: an anterior flange (11); posterior flange (14) which is longer than the anterior flange (11) possessing a plurality of parallel horizontal fastening slots (17) along the length of the posterior flange (14); and a vertical web (18) connecting the anterior flange (11) and posterior flange (14) in parallel forming a generally J-shaped channel. The longer posterior flange with fastener slots permits the construction if the shaft wall assembly solely from within the shaft cavity.

5 Claims, 3 Drawing Sheets

STUD FOR CONSTRUCTION OF SEISMIC AND FIRE RESISTANT SHAFT WALLS

CROSS-REFERENCES TO RELATED APPLICATIONS

Continuation of application Ser. No. 09/436,527 filed Nov. 9. 1999.

BACKGROUND OF THE INVENTION

Field of the Invention

The present invention relates to metal framing construction, and more particularly to a stud for the construction of fire-resistant and seismic resistant shaft walls, i.e., elevator shafts and stairwells, from completely within the shaft cavity.

SUMMARY OF THE INVENTION

The present invention discloses a stud for construction of seismic and fire resistant shaft walls, including but not limited to elevator shafts and stair wells, comprising a vertical web with incongruent anterior and posterior flanges depending therefrom, and multiplicity of horizontal slots incorporated in the posterior flange.

DESCRIPTION OF PRIOR ART

This invention is an improvement over the prior art based upon the ease manufacturing the claimed stud and the ease of constructing a shaft wall assembly strictly from inside the shaft cavity, using the method disclosed in U.S. Pat. No. 5,950,385. Construction of seismic resistant and fire resistant shaft wall assemblies using the stud claimed herein and the method disclosed by U.S. Pat. No. 5,950,385 reduces construction costs based upon the ease of assembly and avoiding construction from both inside and outside the shaft cavity.

Conventional sheet metal wall studs are formed of sheet metal bent into a generally "U-6 shaped" cross-section in which a relatively broad central stud web is flanked by a pair narrower stud sides of equal length that are bent at right angles to the stud web. The stud web typically has a uniform nominal width of either 4 or 3½ inches, and the sides of the u-shaped stud typically extend a nominal distance of two inches from the stud web. The equal sized flanges require the user to work on both sides of the stud to attach opposing wall board to side of the stud. The opposite flange possessing the same length as the near flange obstructs the users ability to attach the opposite wall board. Consequently, screw drivers or screw guns cannot be inserted into the channel formed between the equal size flanges depending from the stud web to attach the wallboard located on the side opposite from the user without the user being positioned on the same side as the wallboard to complete the installation.

Likewise, the slotted channel claimed in U.S. Pat. No. 5,127,203, issued to Robert Paquette suffers from the same limitation as a conventional sheet metal stud. To construct the wall assembly disclosed in U.S. Pat. No. 5,127,203, the user must work on both sides of the slotted channel to install the studs and wallboard. Again, like the conventional sheet metal wall stud, a screw driver, screw gun or nail gun cannot be inserted into the channel formed between the equal size flanges depending from the web of the slotted track to attach the wallboard located on the side opposite from the user. Consequently, the user must be positioned on the same side as the wall board to be installed to complete the installation of the wallboard.

The invention disclosed in U.S. Pat. No. 4,152,878 is not cost effective to produce because the stud requires bending at least six separate locations as well as additional raw material to create the claimed stud. In comparison, the stud claimed herein requires four folds to form the "j"-shaped stud. Thus, less material is required to form the present invention.

U.S. Pat. No. 5,724,784 invented by Robert J. Menchetti, issued on Mar. 10, 1998, discloses a shaft wall supported by a horizontal stud. The Menchetti invention fails to provide a means by which a fire-resistant and seismic resistant shaft wall structure can be constructed. The Menchetti invention claims a means for constructing a static shaft wall which would not survive seismic forces without compromising the integrity of the completed wall structure. Moreover, the Menchetti invention does not claim to create a fire-resistant shaft wall which would satisfy the requirements of existing building codes.

The present invention is an improvement over U.S. Pat. Nos. 4,866,899, 4,364,212 and 3,940,899 which require pop-up tabs extending from the center web of the stud to secure the wall board. The requirement of the pop-up tab requires additional labor and cost to manufacture the pop-up tabs by forming the pop-ups by hand or using a specially designed die. In comparison the present invention secures the wallboard directly to the flanges of the stud without the incorporation of pop-up tabs to secure the wall board. Furthermore, the incorporation of the pop-up tabs in U.S. Pat. Nos. 4,866,899, 4,364,212 and 3,940,899 compromises the strength of the stud.

In addition, U.S. Pat. Nos. 4,866,899, 4,364,212 and 3,940,899 do not provide a means or method for the construction of shaft wall with the ability to withstand seismic and wind sway movement.

U.S. Pat. No. 6,047,508 issued to Goodman is limited to the construction of a moveable wall panel with rigid frame. The invention does not disclose a means or method to construct a partition using a "j"-shaped stud that would withstand seismic forces. The invention claimed by Goodman has no ability to deflect after construction based upon its intended purpose to be a rigid pole which mates with another rigid pole. The "G-shaped" structure disclosed in the Goodman Patent (element 51) does not provide for movement of the attached wallboard, nor does it permit the user to attach opposing wallboard elements from one side. The G-shaped structure disclosed in Goodman performs as nothing more than a conventional stud requiring the attachment of opposing wallboard from each side of the structure based upon the dimensions disclosed therein.

OBJECTS AND ADVANTAGES

The stud for construction of seismic and fire resistant shaft wall assemblies claimed herein permits construction of the shaft wall assembly strictly from within the shaft cavity as a result of the incongruence of the length of the anterior and posterior flanges which transversely depend from the vertical web of the stud thereby forming a generally J-shape cross-section. The incorporation of an elongated posterior flange in relation to the anterior flange allows the user to attach the interior shaft wallboard to the exterior side of the posterior flange from the anterior of the claimed stud. The incongruence between the posterior flange and anterior flange permits the user to insert a screw driver or screw gun into the channel formed between the flanges to securely attach the interior wall of the shaft wall assembly. If the posterior flange and anterior flange are substantially the same length, the user cannot secure the posterior flange to the wallboard which forms the exterior wall of the shaft cavity from the anterior side of the stud because the anterior flange obstructs the insertion of a nail gun or screw driver between the flanges to attach the interior wall board to the posterior flange. Consequently, if the anterior flange and posterior flange are substantially the same length, as found in the prior art, the interior shaft wallboard must be installed from both inside and outside the shaft cavity thereby requiring additional time and labor.

The incorporation of slots in the posterior flange through which the interior wall board is attached permits the wallboard to deflect horizontally as a result of physical forces such as earthquakes and wind sway. The ability of the wallboard to deflect horizontally during physical forces serves to protect the physical integrity of the wallboard against cracking. The existence of cracks in the wall compromises the wall assembly's ability to resist the passage of fire, smoke and hot gases from the shaft cavity into the remainder of the building in the event of a fire. It is accordingly, an object of the invention to provide a stud for construction of a shaft wall assemblies which meets required safety standards for fire, wind loading and seismic forces set forth in current building codes, such as the Uniform Building Code.

It is an additional object to provide a stud for the construction of a cavity shaft wall which is relatively inexpensive, lightweight, and relatively easy to install. In comparison to the prior art, the claimed stud only requires four folds and less raw material for its construction which results in a cheaper selling price to consumer.

These and other objects and advantages of the invention will be more readily apparent when considered in relation to the preferred embodiments of the invention as set forth in the specification and shown in the drawings.

DESCRIPTION OF THE DRAWINGS

Referring now to the drawings which illustrate the invention as follows.

Figure 1:
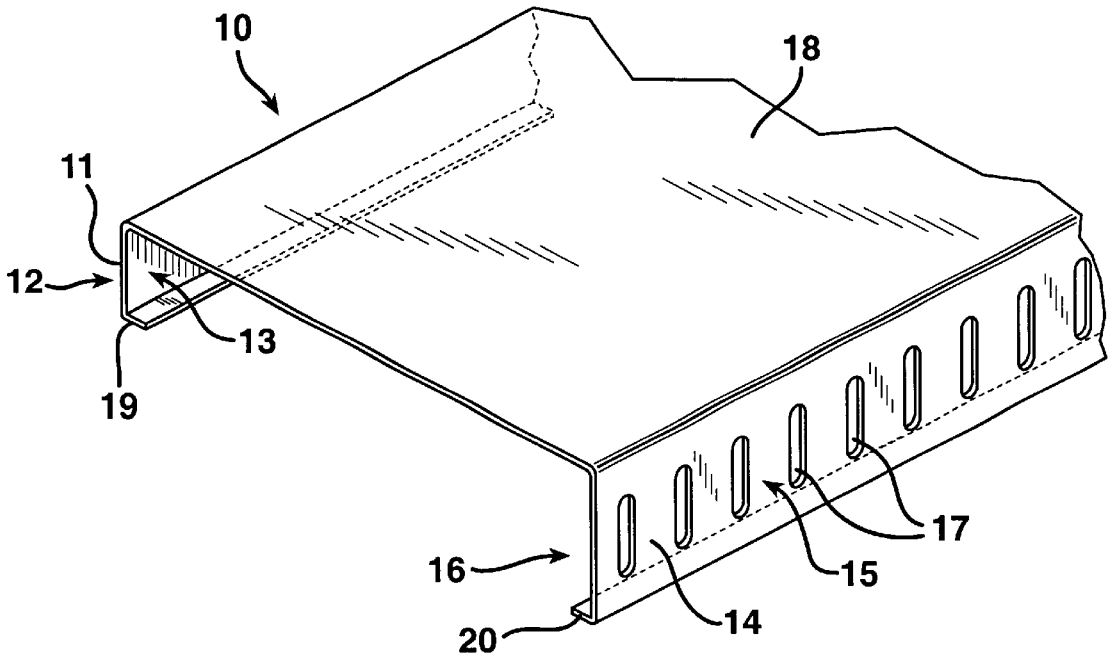
FIG. 1 is a perspective view of the shaft wall stud.

| Reference Numbers In Drawings |
|---|
| 10 seismic slotted stud |
| 11 anterior flange |
| 12 exterior side of anterior flange |
| 13 interior side of anterior flange |
| 14 posterior flange |
| 15 exterior side of posterior flange |
| 16 interior side of posterior flange |
| 17 fastening slots |
| 18 vertical web |
| 19 anterior stiffening lip |
| 20 posterior stiffening lip |
| 21 interior shaft cavity wallboard |
| 22 exterior shaft cavity wallboard |
| 51 self-tapping screw |
| 52 self-tapping screw |

DETAILED DESCRIPTION OF THE PREFERRED EMBODIMENT

The claimed invention 10 consists of a unitary piece of metal formed to create a vertical web 18 with an anterior flange 11 and posterior flange 12 oriented parallel to each other and perpendicularly extending from the vertical web. As used in this patent, anterior refers to the interior shaft cavity wall 21 of the shaft wall assembly, i.e., the wall structure within the shaft cavity. In contrast, posterior refers to the exterior shaft cavity wall 22 which forms the outer wall of the shaft wall assembly, i.e., the wall structure within the building. Further, the term interior side when used in relation to the faces of the flanges 11, 14 depending from the vertical web 18 refers to the side of the flange which faces into the cavity formed between the two flanges 11, 14. By contrast exterior side when used in relation to faces of the flanges 11, 14 appended to the vertical web 18 refers to the side of the flange outside facing outward.

Figure 2:
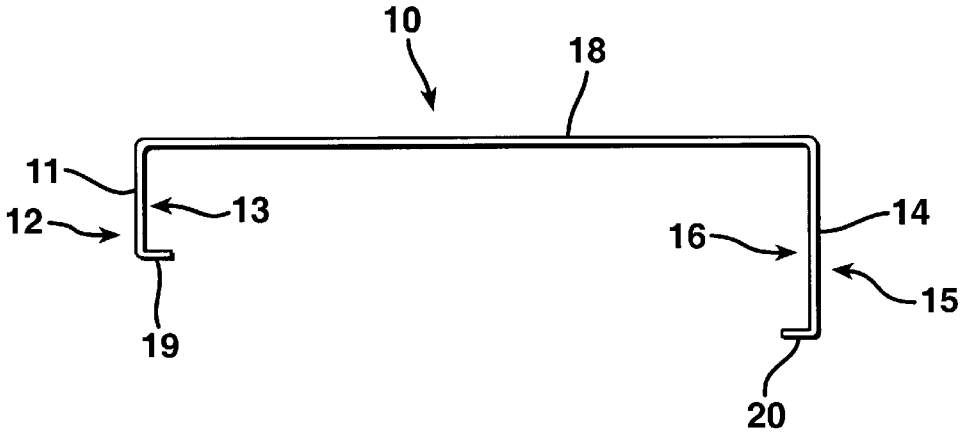
FIG. 2 is a cross-sectional view of the stud in FIG. 1.

Referring now to the drawings, and particularly to FIGS. 1 and 2, a seismic slotted shaft wall stud is illustrated and generally designated by numeral 10. The seismic slotted stud depicted in FIGS. 1 and 2 comprises an elongated lightweight metal stud, formed from sheet metal steel, preferably 20 gauge galvanized steel, and formed as a one piece unit, comprising a central vertical web 18, an anterior flange 11 possessing an interior side 13 and exterior side 12, and an posterior flange 14 possessing an interior side 16 and exterior side 15. The posterior flange 14 incorporates a plurality of slots 13 to connect the interior wallboard 21 of the shaft wall assembly in a manner that permits horizontal deflection as a result of physical forces such as earthquakes, wind sway and inter-story drift. The posterior flange 14 is substantially longer than the anterior flange 11 however the flanges remain generally parallel to each other. The anterior flange 11 and posterior flange 14 depend generally perpendicular from the vertical web 18. The preferred angle from which the anterior flange 11 and posterior flange 14 depend from the vertical web 18 may vary between 85 degrees and 95 degrees.

The anterior flange 11 can be no less than 4.12 centimeters (1⅝ inches) wide. The Uniform Building Code Section 2511.3 and Testing Criteria ASTM-C-843 and 844 require that screws used to attach wallboards to studs must be at least 0.95 centimeters (⅜ inch) from the edge of the wallboard to avoid cracking the wallboard when inserting an attachment crew. Consequently, if the edges of two wallboards abut on the anterior flange the minimum width of the anterior flange is 4.12 centimeters (1⅝ inches) to accommodate the attachment of the adjoining wallboards to the anterior flange using screws positioned at least 1.91 centimeters from the edge of each adjoining wallboard.

The posterior flange 14 can be no less than 5.72 centimeters (2¼ inches) wide. This minimum width is required to accommodate the inclusion of the fastening slots possessing the dimensions listed below. However, the width of the posterior flange 14 must always be greater than the width of anterior flange 11 to permit attachment of the exterior shaft cavity wallboard 22 to the exterior side of the posterior flange 15 from within the shaft cavity. If the anterior flange 11 is substantially equal to or wider than the posterior flange 14, the anterior flange 11 will obstruct the user's ability to attach the exterior shaft cavity wallboard 22 to exterior side of the posterior flange 15 thereby defeating the novelty of this invention, i.e., the construction of a fire and seismic resistant shaft wall from solely within the shaft cavity.

The fastener slots 17 incorporated in the posterior flange 14 permit the joining of two wallboards which abut at the claimed stud. The abutting wallboards are secured to the claimed stud with individual screws through the several fastening slots in the posterior flange. To effectuate this joinder, the fastening slots 17 incorporated on the posterior flange 14 should measure at least 0.64 centimeters (¼ inch) wide and 3.81 centimeters (1½ inches) in length spaced one inch on center along the length of the posterior flange. The 3.81 centimeters (1½ inches) length of the slot permits the attachment of adjoining wallboards at least 0.95 centimeters from the edge of each wallboard to the posterior flange. Again, the 1.91 centimeter attachment offset from the edge of the wallboard thereby avoids cracking the wallboard if the screw attachment penetrates too close to the edge of the wallboard. The dimension and location of the fastening slots 17 along the posterior flange 14 may be increased with proper engineering calculations.

The width of the vertical web 18 is dictated by the width of the shaft wall to be formed. For example, the construction of a six inch shaft wall requires that the claimed invention possess a six inch (15.24 centimeters) wide vertical web.

Figure 3:
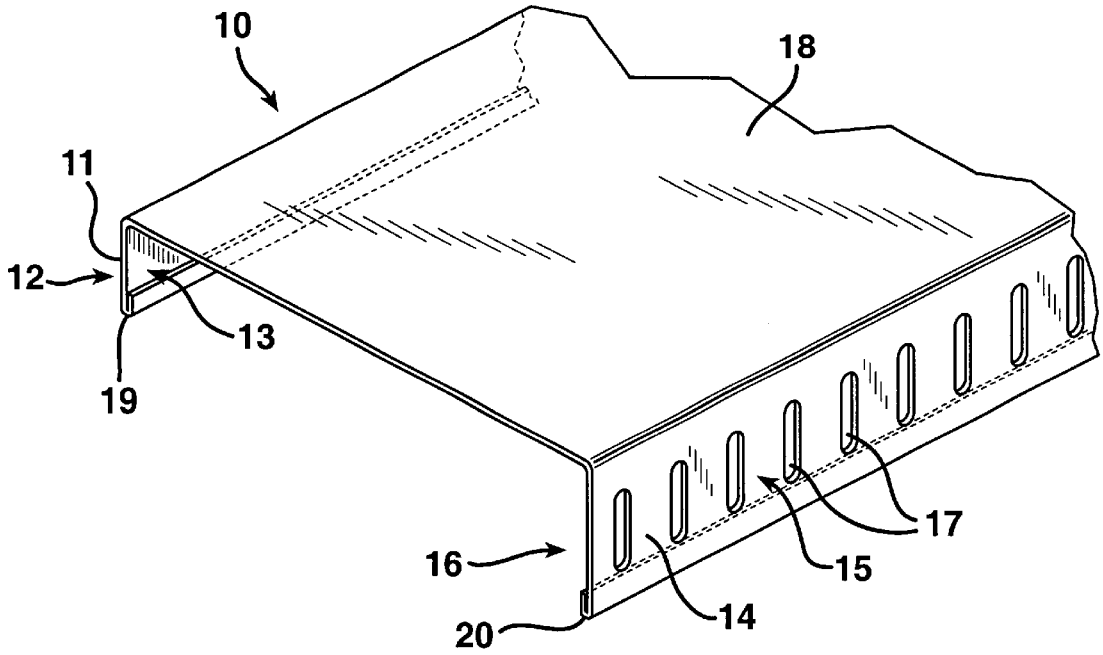
FIG. 3 is an exploded perspective view illustrating the structural details of the shaft wall formed using the claimed stud.
Figure 4:
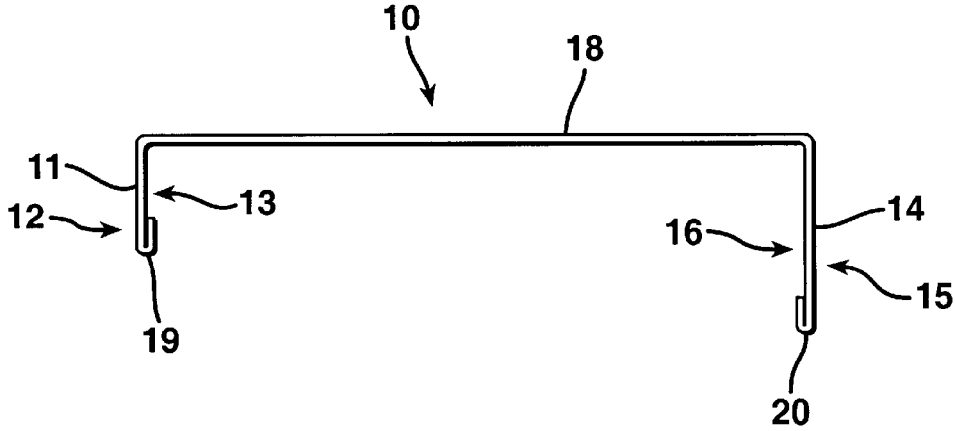
FIG. 4 is a perspective view of the shaft wall stud with strengthening lips.

A second embodiment of this invention is depicted in FIGS. 3 and 4. The addition of stiffening lips 19, 20 anterior flange 11 and posterior flange 14 is recommended to strengthen the rigidity of the flanges. The stiffening lips are formed on the distal portion of the posterior flange and the distal portion of the anterior flange. The preferred width of the anterior flange stiffening lip 19 is 0.31 centimeters (⅛ of an inch) and the preferred length of the posterior flange lip 20 is 1.58 centimeters (⅝ of an inch). The stiffening lips 19,20 may depend perpendicularly from the anterior and posterior flanges 11, 14 into the channel formed between the flanges. It is preferred that the stiffening lip is bent acutely inward and parallel with the flange thereby not encroaching upon the useable space between anterior flange 11 and posterior flange 14 for the insertion of a screw driver or screw gun to attach the exterior shaft cavity wallboard 22 to the posterior flange 14. If perpendicular stiffening lip are added to the distal portion of the anterior leg and the posterior leg to strengthen the claimed stud, a cross section view of the stud reveals a general "G-shape." However, if the stiffening lips are bent acutely inward and parallel to the flanges, the stud retains its general "J-shape." It is preferred that the stiffening lips are bent acutely inward and parallel to the flanges thereby avoiding any obstruction to working area created between the incongruent flanges.

It is preferred that the claimed shaft wall stud is manufactured from galvanized steel. The gauge of metal used varies with the structural strength required for individual construction project. Acceptable gauges of galvanized metal may range from 16 gauge to 24 gauge. It is preferred that the gauge of galvanized steel used to form the seismic slotted shaft wall stud comprise 20 gauge galvanized steel.

Figure 5:
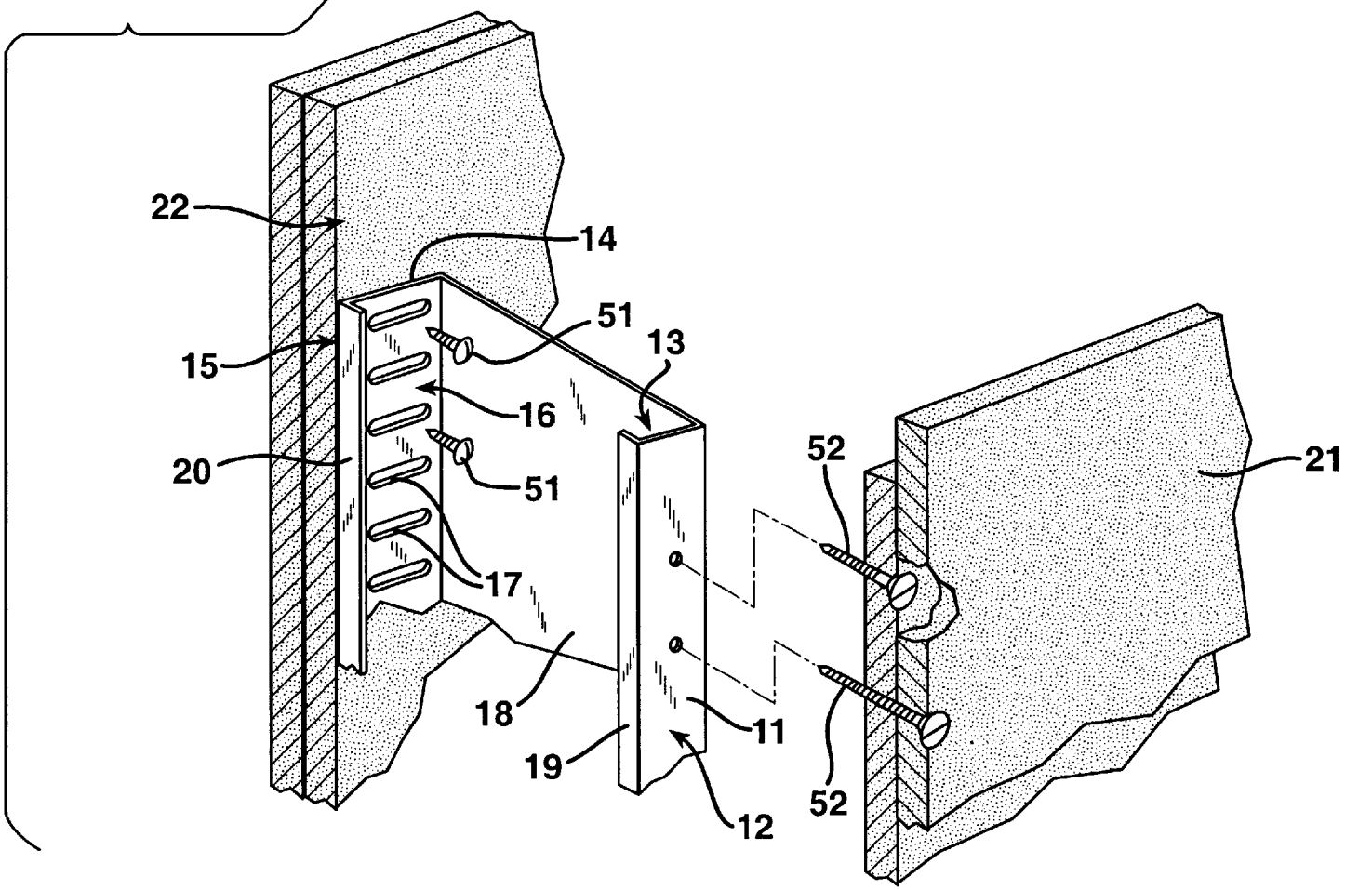
FIG. 5 is a cross-sectional view of the stud in FIG. 4.

FIG. 5 depicts the attachment of wallboards to form the shaft wall assembly. The complete shaft wall assembly and method of construction is disclosed in U.S. Pat. No. 5,950,385 is incorporated by reference in its entirety herein.

Attachment of the interior wallboards via the fastening slots 17 in the posterior flange 14 permits the wallboard 30 to cycle horizontally. The attachment of the shaft wall stud to a slotted connector disclosed in U.S. Pat. No. 5,127,203 as element 34 permits the shaft wall assembly to also deflect vertically.

OPERATION OF THE INVENTION

At each level of the shaft wall assembly, e.g., a floor a multistory building, the exterior shaft cavity wallboard is first installed vertically into the slotted shaft wall connector disclosed in U.S. Pat. No. 5,950,385 as element 34.

Second, the uniquely shaped stud claimed herein is attached vertically to the connector disclosed in U.S. Pat. No. 5,950,385 as element 34. The claimed stud is oriented with the exterior side of the posterior flange 16 in contact with the exterior shaft cavity wallboard 22 and anterior flange 11 oriented to the shaft cavity and the user.

Third, the exterior shaft cavity wallboard 22 is slidably attached to the exterior surface of the posterior flange 15 using self-tapping screws 51. The self tapping screws used to secure the exterior shaft wallboard to the exterior surface of the posterior flange are introduced anteriorly through the fastening slots 17. Generally, either a screw driver or screw gun is inserted between the incongruent flanges to attach the wallboard to the posterior flange.

Fourth, upon completing the attachment of the exterior shaft cavity wall board, the interior shaft cavity wallboard 21 is inserted into the connector disclosed in U.S. Pat. No. 5,950,385 as element 34, and attached to the exterior side of the anterior flange of the claimed stud 12. To attach the wallboard to anterior flange, self-tapping screws 52 are engaged to secure the wallboard to the anterior flange.

Last, to complete the seismic and fire-resistant shaft wall assembly claimed in U.S. Pat. No. 5,950,385 using the claimed stud, compressible fire-safing material such as mineral wool is inserted into all the gaps located at the top of the shaft wall assembly at the top of the interior shaft wall cavity wallboard and the connector. The inclusion of compressible fire-safing material permits the shaft wall assembly to deflect as a result of physical forces without compromising the integrity of the fire-resistance at the top of the shaft wall assembly if the voids were left empty or if cementitious material was used therein. Cementitious material such as MONOKOTE® crack as a result of the deflection thereby allowing fire, hot gases and smoke to travel from the shaft cavity to the interior of the building.

Having completed a detailed disclosure of the preferred embodiments of my invention, so that those skilled in the art may practice same, I contemplate variations may be made without departing from the essence of the invention claimed herein.

I claim:

1. A stud for construction of seismic and fire resistant shaft walls comprising:

a vertical web;

an anterior flange no less than 4.12 centimeters wide extending transversely from said vertical web possessing a distal portion, an exterior side and an interior side;

a posterior flange no less than 6.35 centimeters wide possessing a distal portion, an exterior side and interior side extending transversely from said vertical web substantially parallel to said anterior flange;

said posterior flange extends further from said vertical web than said anterior flange thereby defining a substantially "J-shape" cross-section;

a plurality of horizontal slots spaced vertically apart and substantially parallel to one another incorporated along the vertical length of said posterior flange to slideably attach wallboard material thereto.

2. The stud as defined in claim 1 wherein said slots in said posterior flange are 3.81 centimeters long and 0.635 centimeters wide and spaced apart 2.54 centimeters center to center.

3. The stud as defined in claim 1 wherein an anterior stiffening lip depends perpendicularly from the distal portion of said anterior flange toward the posterior flange; and a posterior stiffening lip depending perpendicularly from the distal portion of said posterior flange toward the anterior flange.

4. The as defined in claim 3 wherein said anterior stiffening lip is bent acutely and parallel to said anterior flange, and said posterior stiffening lip is bent acutely and parallel to said anterior posterior flange.

5. A stud for construction of seismic and fire resistant shaft walls comprising:

a vertical web;

an anterior flange no less than 4.12 centimeters wide extending transversely from said vertical web possessing a distal portion, an exterior side, and an interior side;

a posterior flange no less than 6.35 centimeters wide possessing a distal portion, an exterior side and interior side extending transversely from said vertical web substantially parallel to said anterior flange;

said posterior flange extends further from said vertical web than said anterior flange thereby defining a substantially "J-shape" cross-section;

an anterior stiffening lip depending perpendicular from the distal portion of said anterior flange toward the posterior flange;

a posterior stiffening lip depending perpendicular from the distal portion of said posterior flange toward the anterior flange;

a plurality of horizontal slots spaced vertically apart and substantially parallel to one another incorporated along the vertical length of said posterior flange to slidably attach wallboard material thereto.

* * * * *